United States Patent [19]

Barrett, Sr.

[11] 4,360,935

[45] Nov. 30, 1982

[54] DEEP BATHTUB WITH ELEVATED SEAT AND ENTRANCE DOOR

[76] Inventor: John P. Barrett, Sr., 879 Harbor Island, Clearwater, Fla. 33515

[21] Appl. No.: 300,289

[22] Filed: Sep. 8, 1981

[51] Int. Cl.[3] ..... A47K 3/02

[52] U.S. Cl. ..... 4/555; 4/556

[58] Field of Search ..... 4/555, 556, 557, 559, 4/584, 596, 604, 605

[56] References Cited

U.S. PATENT DOCUMENTS

| | | | |
|---|---|---|---|
| 2,456,275 | 12/1948 | Harris | 4/556 |
| 2,569,825 | 10/1951 | Otis | 4/556 |
| 2,570,053 | 10/1951 | Fowler et al. | 4/556 |
| 3,066,316 | 12/1962 | Russell | 4/556 |
| 3,371,354 | 3/1968 | Hayslett | 4/556 |
| 3,380,078 | 4/1968 | Hanson | 4/555 |
| 3,719,960 | 3/1973 | Russell | 4/556 |
| 3,863,275 | 2/1975 | Brendgord et al. | 4/556 |
| 3,864,762 | 2/1975 | Finch et al. | 4/555 |
| 4,118,810 | 10/1978 | Brickhouse et al. | 4/556 |

*Primary Examiner*—Henry K. Artis

*Attorney, Agent, or Firm*—Harvey B. Jacobson

[57] ABSTRACT

An upwardly opening receptacle is provided including a bottom and upstanding wall portions projecting upwardly from the bottom and extending peripherally thereabout. One of the wall portions has a door opening formed therein and a horizontally swingable and inwardly opening door is hingedly supported from the one wall portion for movement between a closed position closing the opening and an open position adjacent and opposing the inner surface of a second wall portion of the tub. The tub includes structure defining a seat therein facing the aforementioned second wall portion and disposed to the side of the opening remote from the second wall portion. The one wall portion and the door include peripheral portions disposed about the opening and the door defining abuttingly engageable stop surfaces for limiting movement of the door toward the closed position. The one wall portion and the door further include coacting seal forming portions thereof spaced inward of the stop surfaces to define a fluid-tight seal between the door and the one wall portion when the door is in the closed position.

9 Claims, 10 Drawing Figures

DEEP BATHTUB WITH ELEVATED SEAT AND ENTRANCE DOOR

BACKGROUND OF THE INVENTION

Various forms of tubs heretofore have been designed including door openings in selected side walls thereof and doors for those openings whereby the latter may be selectively opened and closed. Most tubs equipped with side doors are deeper than the usual tubs and the door openings thereof enable physically disabled persons to easily gain access to and to egress from a tub.

However, some door equipped tubs use vertically slidable doors which may be fully removed from a closed position only by upward displacement of the door and other tub doors swing outward. Doors which must be lifted upwardly toward an open position are difficult to operate by physically disabled persons and doors which open outwardly inherently present door sealing problems. Of course, it is old to provide a door which opens inwardly in other environments, and such an inwardly opening door may be provided on a bathtub and utilize the head pressure of water within the tub urging the door toward a closed position to facilitate the formation of a tight seal between the door and the associated opening. However, an inwardly opening door can constitute an obstacle against easy egress from a tub by a physically disabled person.

Examples of various of forms of tubs equipped with doors are disclosed in U.S. Pat. Nos. 2,569,825, 3,371,354, 3,380,078, 3,663,971, 3,863,275, 4,099,272 and 4,118,810.

BRIEF DESCRIPTION OF THE INVENTION

The bathtub of the instant invention may be termed a "deep" bathtub and is equipped with a seat therein adjacent one side wall thereof. An adjoining side wall of the tub (which is generally rectangular in plan) includes a door opening therein in the portion of the adjoining side wall remote from the seat and a horizontally swingable door is provided for the opening. The door is swingable inwardly of the tub toward the open position away from the one side wall of the tub with which the seat is integrally formed and toward a third side wall of the tub opposite the first side wall. In this manner, a person within the tub may readily egress therefrom. Further, the drain for the tub is formed in the bottom wall thereof closely adjacent the third side wall of the tub and the fourth side wall of the tub remote from the side wall having the door opening formed therein is equipped with the hot and cold water controls as well as the drain control closely adjacent the seat.

The door of the tub swings inward toward the open position and the side wall of the tub in which the opening is formed defines stop flanges extending about the opening against which marginal portions of the door abut to limit swinging movement of the door to the closed position. In addition, marginal portions of the door and the wall in which the opening is formed include coacting fluid-tight seal forming structure inward of the stop flanges for forming a fluid-tight seal between the door and those wall portions defining the marginal portions of the door opening. Also, latch structure is provided on the door and engageable with portions of the wall in which the door opening is formed in order to latch the door in a closed position.

Inasmuch as the door opens inwardly and the coacting seal structure is constructed to increase the sealing action thereof as the door swings to its final closed position, the head pressure of water within the tub acting upon the door provides the necessary horizontal lateral thrust on the door to assure proper sealing thereof relative to the associated wall portion.

The main object of this invention is to provide a "deep" bathtub including a door opening in one side wall thereof and a horizontally swingable door for the opening whereby a physically disabled person may readily gain access to and egress from the interior of the tub.

Another object of this invention is to provide a bathtub in accordance with the preceding object and including a door therefor which swings horizontally inwardly toward the open position and is constructed in a manner to utilize water pressure against the inner side of the door when the door is closed in order to assure a full fluid-tight seal between the door and the marginal wall portions of the tub disposed about the door opening.

Yet another object of this invention is to provide a bathtub having an integral seat therein and with the seat, the door opening and the hinging action of the door being related to each other in a manner such that horizontal inward swinging of the door toward the open position may be readily effected by a person seated on the seat and that person may readily egress from the tub after the door has been opened without interference with the door.

Still another object of this invention is to provide a bathtub including bottom drain and water and drain controls so positioned relative to the seat and the door whereby the drain will be disposed in a position within the interior of the tub which is normally not occupied by a person using the tub and the water and drain control may be readily actuated by a person within the tub disposed on the seat thereof.

A final object of this invention to be specifically enumerated herein is to provide a tub in accordance with the preceding objects and which will conform to conventional forms of manufacture, be of simple construction and easy to use so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
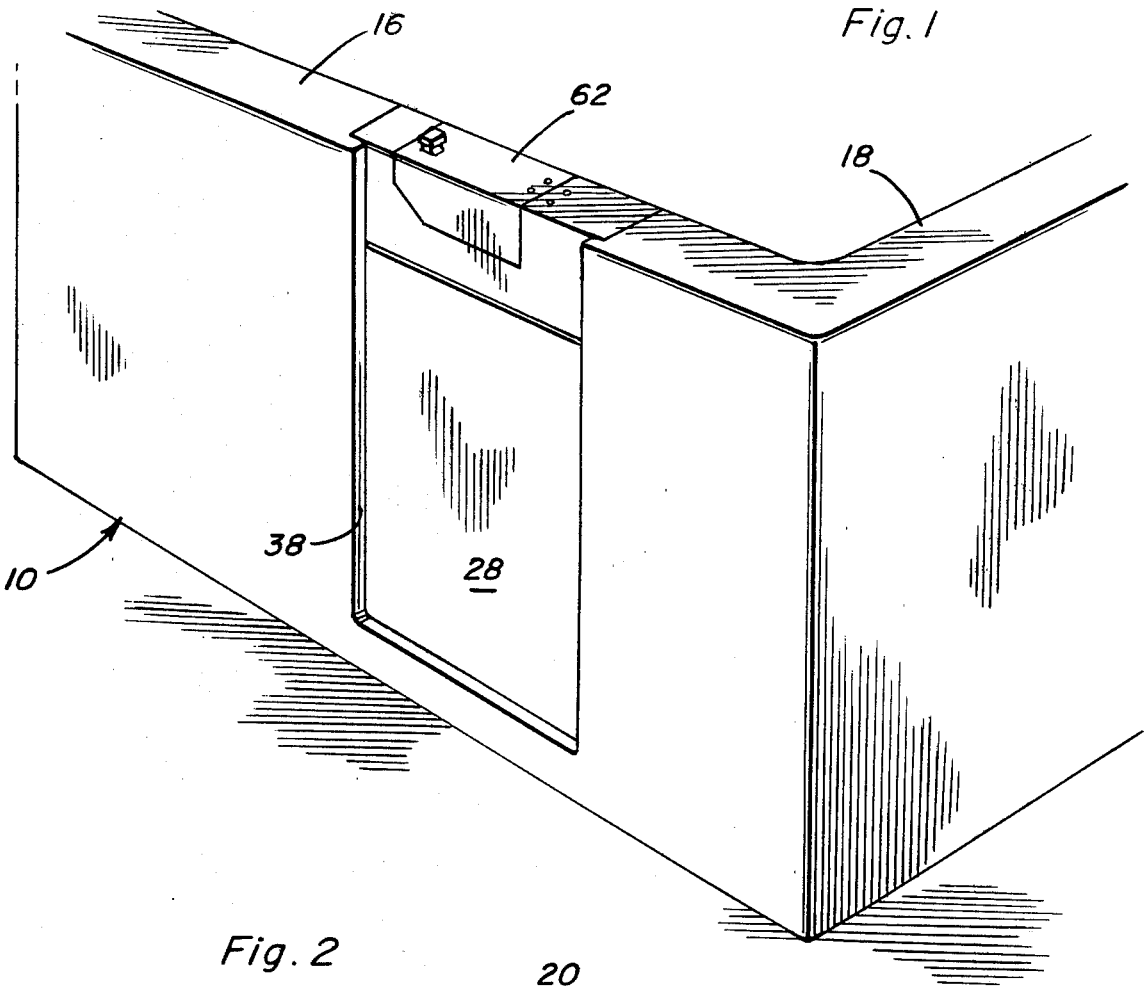
FIG. 1 is a fragmentary perspective view of the tub as seen from the exterior thereof and illustrating the door opening and associated horizontally inwardly swinging door (the latter being in a closed position)

Referring now more specifically to the drawings, the numeral 10 generally designates the bathtub of the instant invention. The bathtub 10 includes a bottom wall 12 and upstanding first, second, third and fourth side walls 14, 16, 18 and 20 which extend peripherally about and project upwardly from the outer marginal portions of the bottom wall 12. Accordingly, as may be seen from FIG. 2, the tub 10 is generally rectangular in plan. It may also be seen from FIG. 2 that the bottom wall 12 includes a drain 22 in the marginal portion thereof immediately adjacent rectangular in plan. It may also be seen from FIG. 2 that the bottom wall 12 includes a drain 22 in the marginal portion thereof immediately adjacent the side wall 18, the side wall 20 includes a control station 24 including controls for cold and hot water and the drain 22 and the side wall 16 has a door opening 26 formed therein with which a horizontally swingable door 28 is operatively associated. Further, it may be seen from FIG. 2 that the side wall 14 has a horizontal elevated seat 30 formed integrally therewith. The seat 30 extends between the ends of the side walls 16 and 20 adjacent the side wall 14 and is also formed integrally with the side walls 16 and 20. Further, the side walls 16 and 20 include horizontally inwardly projecting hand grips 32 and 34 to facilitate the use of the tub 10 by a physically disabled person, the hand grips 32 and 34 serving to allow a physically disabled person to assume a seated position on the seat 30 and to rise upwardly therefrom toward a standing position.

Figure 3:
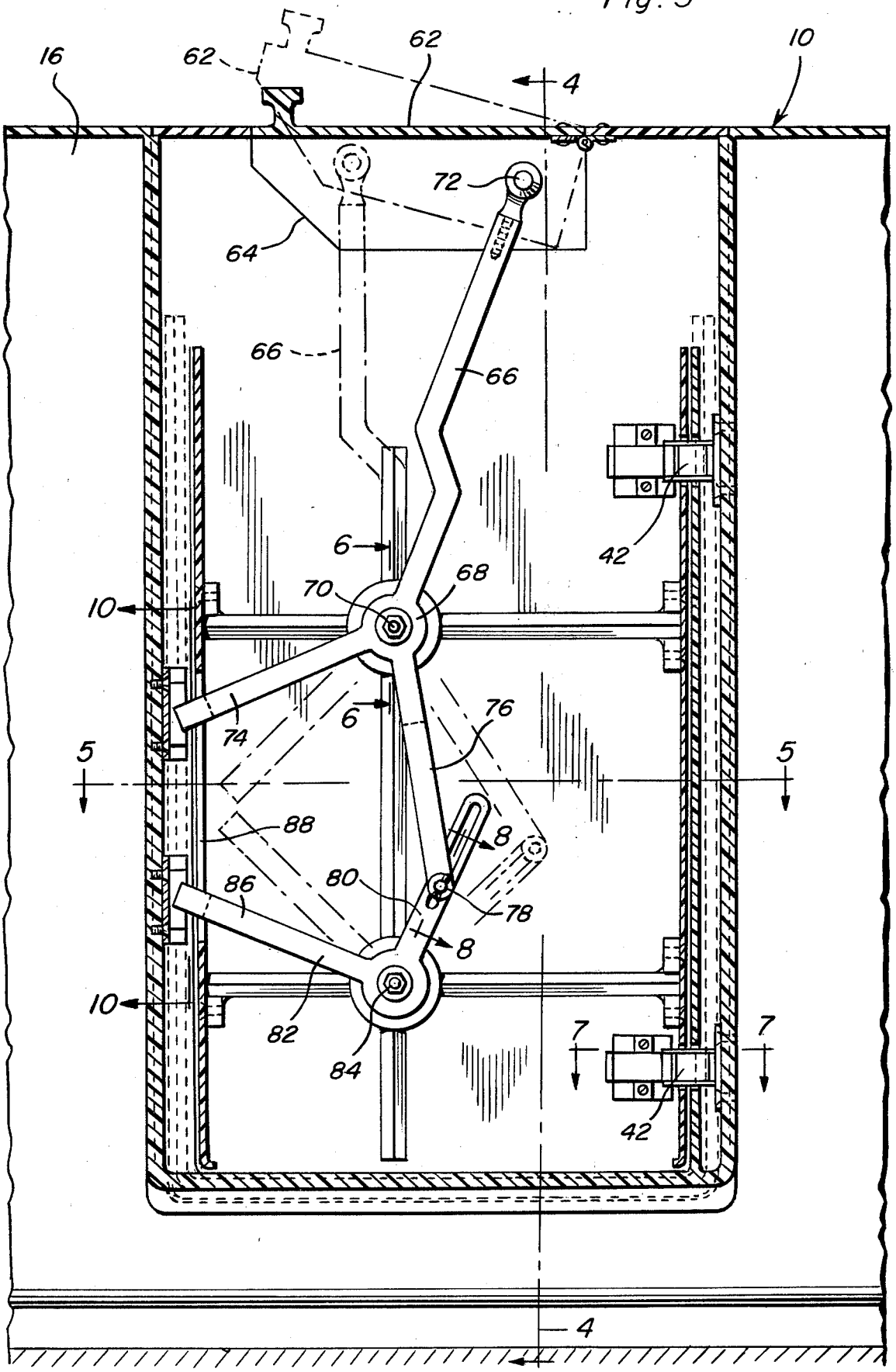
FIG. 3 is an enlarged fragmentary vertical sectional view taken substantially upon the plane indicated by the section line 3—3 of FIG. 2.
Figure 4:
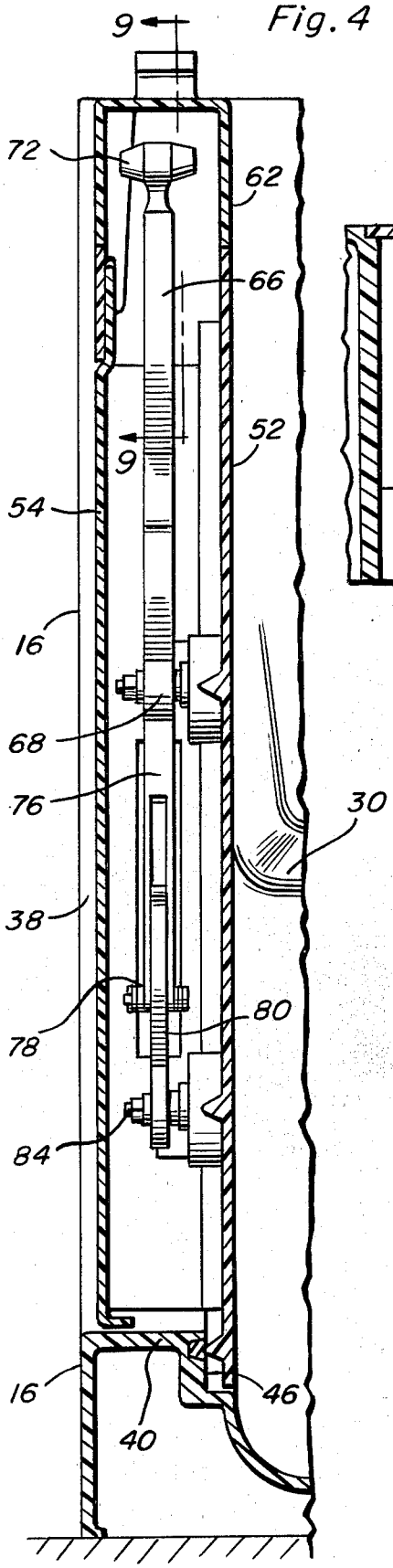
FIG. 4 is a fragmentary vertical sectional view taken substantially upon the plane indicated by the section line 4—4 of FIG. 3.
Figure 9:
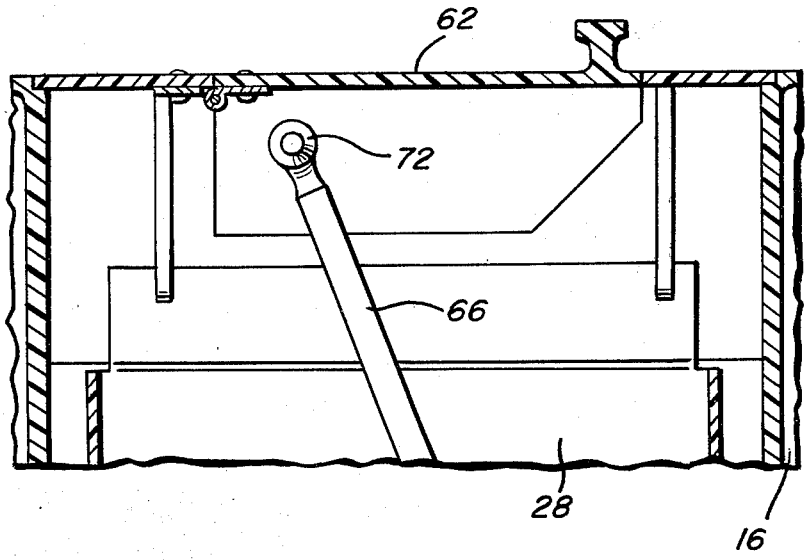
FIG. 9 is a fragmentary vertical sectional view taken substantially upon the plane indicated by the section line 9—9 of FIG. 4.
Figure 10:
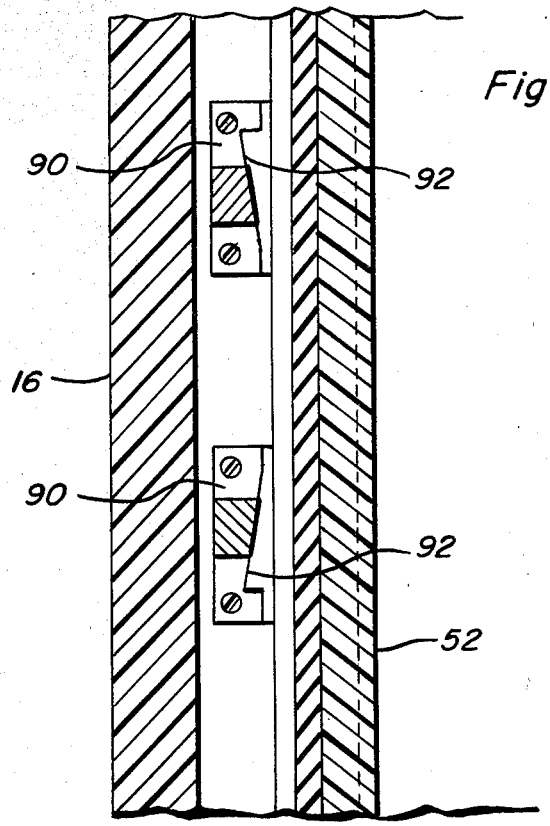
FIG. 10 is an enlarged fragmentary vertical sectional view taken substantially upon the plane indication by the section line 10—10 of FIG. 3.
Figure 5:
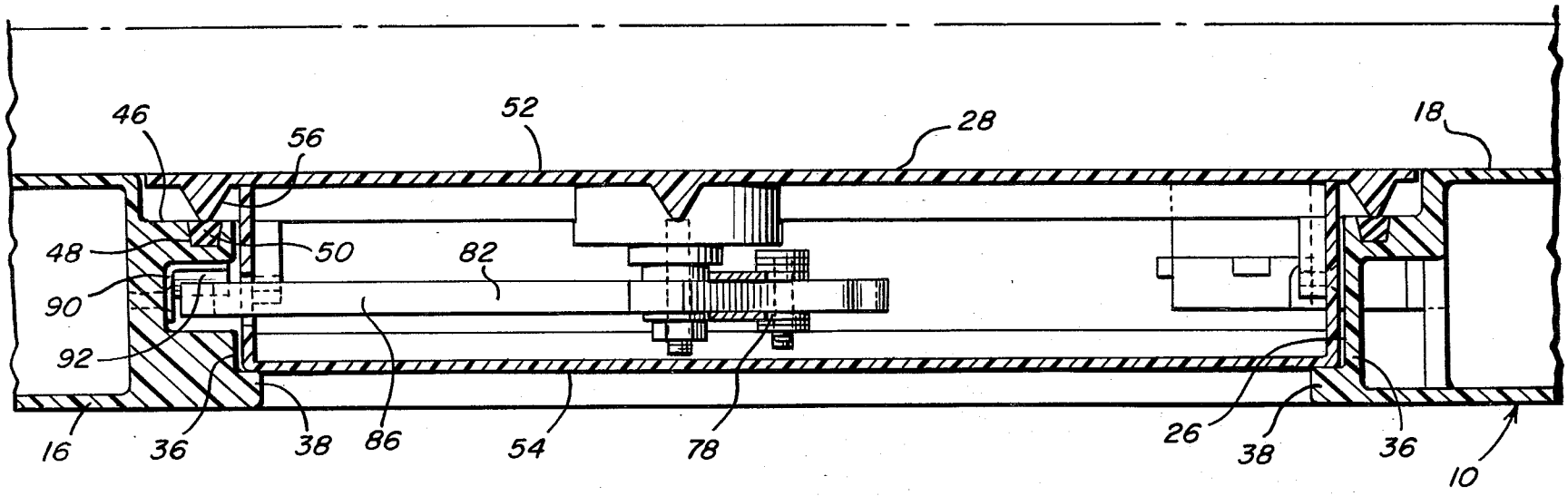
FIG. 5 is an enlarged fragmentary horizontal sectional view taken substantially upon the plane indicated by the section line 5—5 of FIG. 3.
Figure 8:
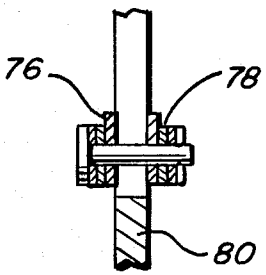
FIG. 8 is a fragmentary enlarged sectional view taken substantially upon the plane indicated by the section line 8—8 of FIG. 3.
Figure 7:
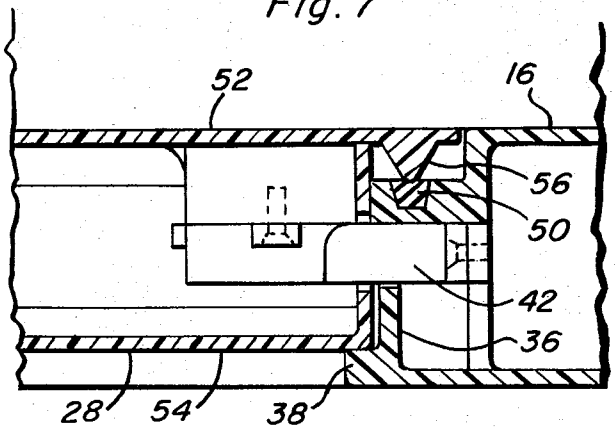
FIG. 7 is an enlarged fragmentary horizontal sectional view taken substantially upon the plane indicated by the section line 7—7 of FIG. 3.
Figure 6:
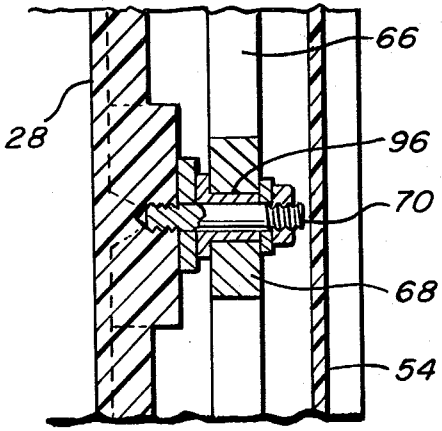
FIG. 6 is a further enlarged vertical sectional view taken substantially upon the plane indicated by the section line 6—6 of FIG. 3.

With attention now invited more specifically to FIGS. 3, 4 and 5 of the drawings, it may be seen that the opening 26 includes opposite generally vertical marginal portions 36 defining slightly inwardly projecting stop flanges 38, the lower marginal portion 40 of the wall 16 being free of a stop flange.

Figure 2:
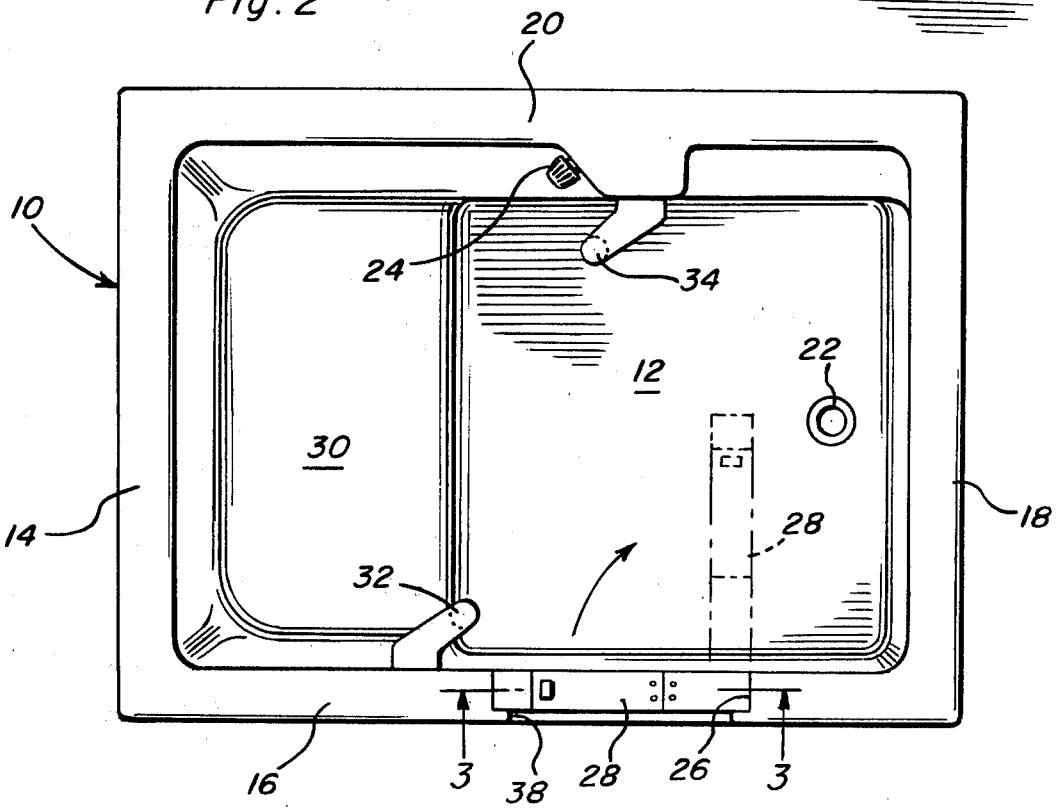
FIG. 2 is a top plan view of the tub on a reduced scale and illustrating the open position of the door in phantom lines.

The door 28 is hingedly supported from the marginal portion 36 adjacent the side wall 18 through the utilization of link-type hinges 42 and is swingable between the closed position thereof illustrated in FIGS. 2 and 5 and the open phantom line position thereof illustrated in FIG. 2. When being swung from the closed position toward the open position, the door 28 is swung inwardly of the side wall 16 and toward the side wall 18. When the door 28 is swung to the closed position, those door marginal portions which oppose the flanges 38 abut the latter in order to limit swinging movement of the door 28 to the closed position. In addition, the wall 16 includes an inwardly facing recessed step 46 extending peripherally about the opening 26 along both vertical marginal edges thereof and across the lower marginal edge thereof and the step 46 includes an inwardly opening channel 48 formed therein in which a resilient seal strip 50 is secured.

The door 28 is hollow and includes an inner panel 52 and an outer panel 54. The inner panel 52 includes a peripheral outwardly projecting rib 56 which abuts against and at least partially compresses the central area of the seal strip 50 when the door 28 is in the closed position, the seal strip 50 and ridge 56 being disposed inward of the stop flanges 38.

The upper marginal portion of the door 28 includes a hinged partial cap 62 which may be swung from the closed position thereof illustrated in solid lines in FIG. 3 closing an access opening 64 formed in the upper marginal portion of the door 28 past the partially open phantom line position of the cap illustrated in FIG. 3 toward a substantially upstanding fully open position exposing the upper end of an upstanding control handle 66 whose vertical midportion 68 is oscillatably mounted within the door 28 by a pivot shaft 70.

The upper end of the control handle 66 includes a T-shaped hand grip defining head 72 supported therefrom and the lower end of the control handle 66 includes a first latch arm 74 and a second control arm 76. The free end of the control arm 76 is operably connected, via a pin and slot connection 78, to a control arm 80 of a bell crank 82 oscillatably supported from the door 28 by a second pivot shank 84 and the bell crank 82 includes a latch arm 86 similar to the latch arm 74.

The free ends of the latch arms 74 and 86 are projectible and retractable through an opening 88 provided therefor in the free swinging edge of the door 28 and the marginal portion of the wall 16 toward and away from which the free swinging edge of the door 28 swings includes a pair of vertically spaced recessed latch plates 90 including cam surfaces 92 with which the free ends of the latch arms 74 and 86 are engageable upon movement of the control handle 66 from the phantom line position thereof illustrated in FIG. 3 to the solid line position of FIG. 3 in order to latch the door 28 in the fully closed position with the ridge 56 tightly compressively engaging the seal strip 50.

The pivot connection between the control handle 66 and the pivot shaft 70 is suitably bushed as at 96 and the pivot connection between the bell crank 82 and the pivot shaft 84 is similarly bushed.

With attention now invited more specifically to FIG. 2 of the drawings, it may be seen that the seat 30 and drain 22 are disposed on opposite sides of the door opening 26. Further, the controls 24 are disposed on the side wall 20 remote from the door opening 26 and the door 28 swings inwardly toward the side wall 18 remote from the seat 30. Accordingly, a person wishing to enter the tub or to egress therefrom may readily move through the opening 26 between the exterior of the tub 10 and the seat 30 without interference from the door 28 or the drain 22. Further, the hand grips 32 and 34 are optimumly positioned relative to the seat 30 in order to enable their use in a person achieving a seated position on the seat or rising from the seat to a standing position. Also, the partial cap 62 may be readily upwardly swung from the closed position thereof illustrated in FIG. 3 in order to expose the hand grip 72 and the latter may be readily actuated in order to cause the latch arms 74 and 76 to tightly latch the door 28 in the closed position.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A bathtub for the physically disabled, said tub including an upwardly opening receptacle having a bottom and upstanding wall portions projecting upwardly from said bottom and extending peripherally thereabout, one of said wall portions having a door opening formed therein, a horizontally swingable and inwardly opening door hingedly supported from said one wall portion for movement between a closed position closing said opening and an open position adjacent and opposing the inner surface of a second wall portion of said tub, said tub including means defining a seat therein facing said second wall portion and disposed to the side of said opening remote from said second wall portion, said one wall portion and said door including peripheral portions disposed about said opening and said door defining abuttingly engageable stop surfaces for limiting movement of said door toward said closed position, said one wall portion and door further including coacting seal forming portions thereof spaced inward of said stop surfaces and engageable with each other to define a fluid-tight seal between said door and said one wall portion when said door is in the closed position, whereby the static head pressure of water within the tub and acting upon the door will assist said seal forming portions in forming said fluid-tight seal, said door and one wall portion including releasable latch structure for latching said door in the closed position, said latch structure including a latch actuator and release shiftably supported from said door for back and forth movement between release and latching positions along a path generally paralleling the horizontal extent of said one wall portion about the periphery of said tub.

2. The tub of claim 1 wherein said operator is recessed in and shiftable along the upper marginal portion of said door.

3. The tub of claim 2 wherein said upper marginal portion of said door has an upwardly opening notch formed therein, said operator projecting upwardly into said notch from below the latter.

4. The tub of claim 3 wherein the upper marginal portion of said door includes a partial cap hingedly supported therefrom and swingable into and out of position closing said notch from above.

5. The tub of claim 1 wherein said tub is generally rectangular in plan shape, said seat being disposed adjacent the wall of said tub opposite said second wall, said one wall extending between corresponding ends of said second wall and said wall opposite said second wall.

6. The tub of claim 5 including hot and cold water inlet control means supported from the wall of said tub opposite said one wall.

7. The tub of claim 6 wherein said bottom includes a drain adjacent said second wall and said drain and seat are disposed on opposite sides of a path containing said opening and extending between said one wall and the tub wall opposite said one wall.

8. The tub of claim 7 wherein said operator is recessed in and shiftable along the upper marginal portion of said door.

9. The tub of claim 8 wherein said upper marginal portion of said door has an upwardly opening notch formed therein, said operator projecting upwardly into said notch from below the latter.

* * * * *